US006035547A

United States Patent [19]

Hess et al.

[11] Patent Number: 6,035,547

[45] Date of Patent: Mar. 14, 2000

[54] WATER-BORNE BASECOAT FLASH PROCESS

[75] Inventors: John C. Hess, Rochester; Dennis D. Davidson, Troy, both of Mich.

[73] Assignee: Chrysler Corporation, Auburn Hills, Mich.

[21] Appl. No.: 09/135,499

[22] Filed: Aug. 17, 1998

[51] Int. Cl.[7] ..... F26B 3/34

[52] U.S. Cl. ..... 34/270; 432/121

[58] Field of Search ..... 34/270, 271, 272, 34/269; 432/121, 72

[56] References Cited

U.S. PATENT DOCUMENTS 5,309,650 5/1994 Josefsson et al. .
5,456,023 10/1995 Farnan ..... 34/270
5,588,830 12/1996 Josefsson et al. ..... 432/137
5,689,899 11/1997 Szenker ..... 34/270
5,709,038 1/1998 Scheufler et al. ..... 34/475

*Primary Examiner*—Henry Bennett
*Assistant Examiner*—Malik N. Drake
*Attorney, Agent, or Firm*—Lawrence J. Shurupoff

[57] ABSTRACT

A method for flashing an object painted with a water-borne high-solids automotive paint that substantially reduces the frequency of base-coat pop defects. The method subjects the painted objects to a first set of environmental conditions wherein the air temperature, relative humidity and airflow rate are maintained within certain ranges. The painted objects are maintained in these conditions for a period of time which exceeds an empirically derived minimum value. The peak metal temperature of the painted object is then raised to a second temperature range while being subjected to a second relative humidity level and second airflow rate so as to dehydrate the paint film to a predetermined level.

9 Claims, 3 Drawing Sheets

FIGURE 1
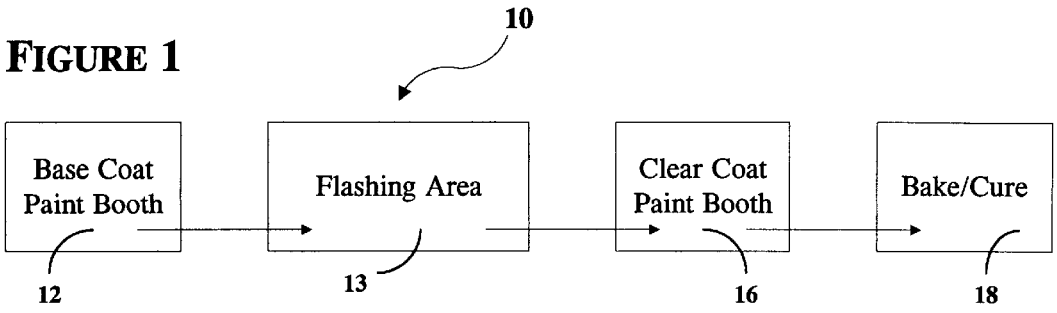
FIGURE 1A
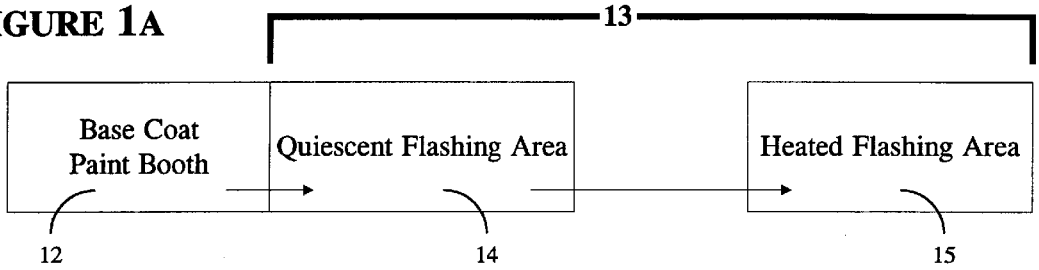
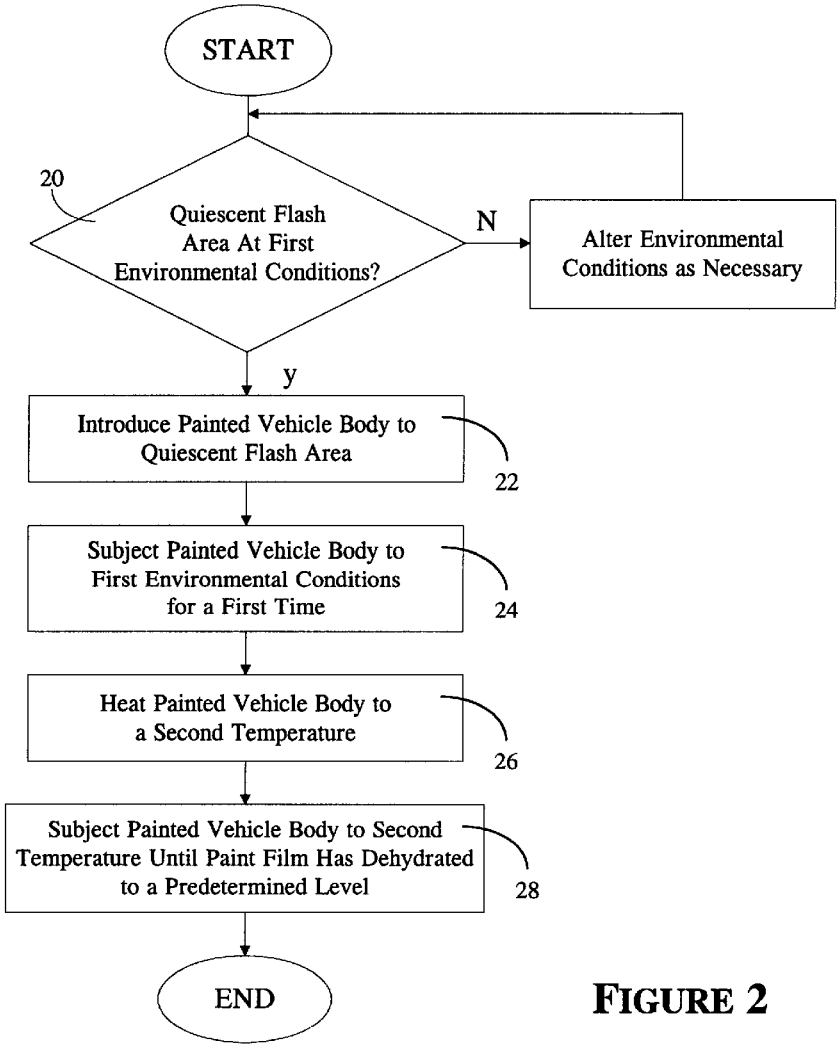
FIGURE 2

WATER-BORNE BASECOAT FLASH PROCESS

BACKGROUND OF THE INVENTION

1. Field of the Invention

The present invention relates to a method for flashing volatile organic compounds from a painted object and more specifically to a method for flashing volatile organic compounds and water from a vehicle painted with a water-borne high-solids automotive base coat paint.

2. Related Art

The paint finish on a new vehicle is often regarded as the single most noticeable visual feature of the vehicle. When the finish is smooth, even and attractive, the vehicle owner is likely to be influenced as to the quality of the vehicle in a positive manner. Conversely, when the paint finish contains defects, the owner is more likely to complain to the vehicle dealer and attribute a lack of quality to the vehicle generally. Accordingly, vehicle manufacturers and paint suppliers have expended vast resources to produce enhanced paint application processes to improve the quality of the finish of the vehicle and eliminate defects associated with the application of paint to the vehicle.

Despite these efforts, modern automotive paint systems which apply water-borne high-solids automotive base coat paints still experience significant application related paint defects such as bubbling, pop and orange peel. Pop defects are initially bubbling defects. Bubbling occurs when air, water vapor and/or vaporized solvents are entrapped in the paint film; the pocket of trapped air, water vapor and/or solvents causes a bubble of paint to form in the paint film. Pop occurs when this bubble bursts and the paint which had formed the bubble sets before this excess paint flows out in an even manner to the surrounding area. A small ring of paint having a significantly greater thickness than the paint in the surrounding area typically characterizes pop defects. Orange peel is a term for a dried paint film having a dimpled appearance resembling the peel of an orange.

Pop defects have been particularly enigmatical as the prior art methods for controlling this defect have not been consistently successful in producing significant reductions in the frequency of pop defects. These prior art methods have typically focused on paint formulations, paint application methods and flashing processes subjecting the painted object to relatively high levels of heat.

Pop defects are usually not detected until the object has been processed through the primary paint process since most modern automotive paint systems do not completely dry the base coat of paint until a top coat of clear paint (clear-coat) has been applied. The repair of a pop defect is time consuming as the effected area must be sanded to remove the pop defect, paint is applied to the defective area and feathered into surrounding areas, the paint is flashed and dehydrated and then a clear-coat is applied to the area and feathered into surrounding areas. As one would expect, the resulting quality of the finish of a repaired pop defect is highly dependent upon the skill of the technician performing the repair. Regardless of the skill level of the technician, however, the finish of a repaired vehicle will always be inferior to the finish of a vehicle processed through a paint system without defects, especially when metallic-type basecoats are used, as the feathered edges of the repaired area will always be visible to some degree.

Consequently, there remains a need in the art for a method to reduce the frequency of pop defects.

BRIEF SUMMARY OF THE INVENTION

It is therefore an object of the present invention to provide a method for flashing an object painted with a water-borne high-solids automotive base coat paint which substantially reduces the frequency of pop defects.

Briefly, the present invention comprises a method for flashing an object painted with a water-borne high-solids automotive base coat paint so as to reduce pop defects. The flashing method is a two-part process wherein flashing in the first part of the process takes place at approximately the same environmental air conditions as the paint booth (e.g., temperature, humidity, rate of air flow) for a predetermined time and flashing in the second part of the process takes place at elevated temperatures until the paint has been dehydrated to a predetermined level.

Additional advantages and features of the present invention will become apparent from the subsequent description and the appended claims, taken in conjunction with the accompanying drawings.

BRIEF DESCRIPTION OF THE DRAWINGS

FIG. 1 is a schematic view of an exemplary automotive paint system.

FIG. 2 is a flow chart depicting the flashing process of the present invention.

DETAILED DESCRIPTION OF THE DRAWINGS

Figure 3:
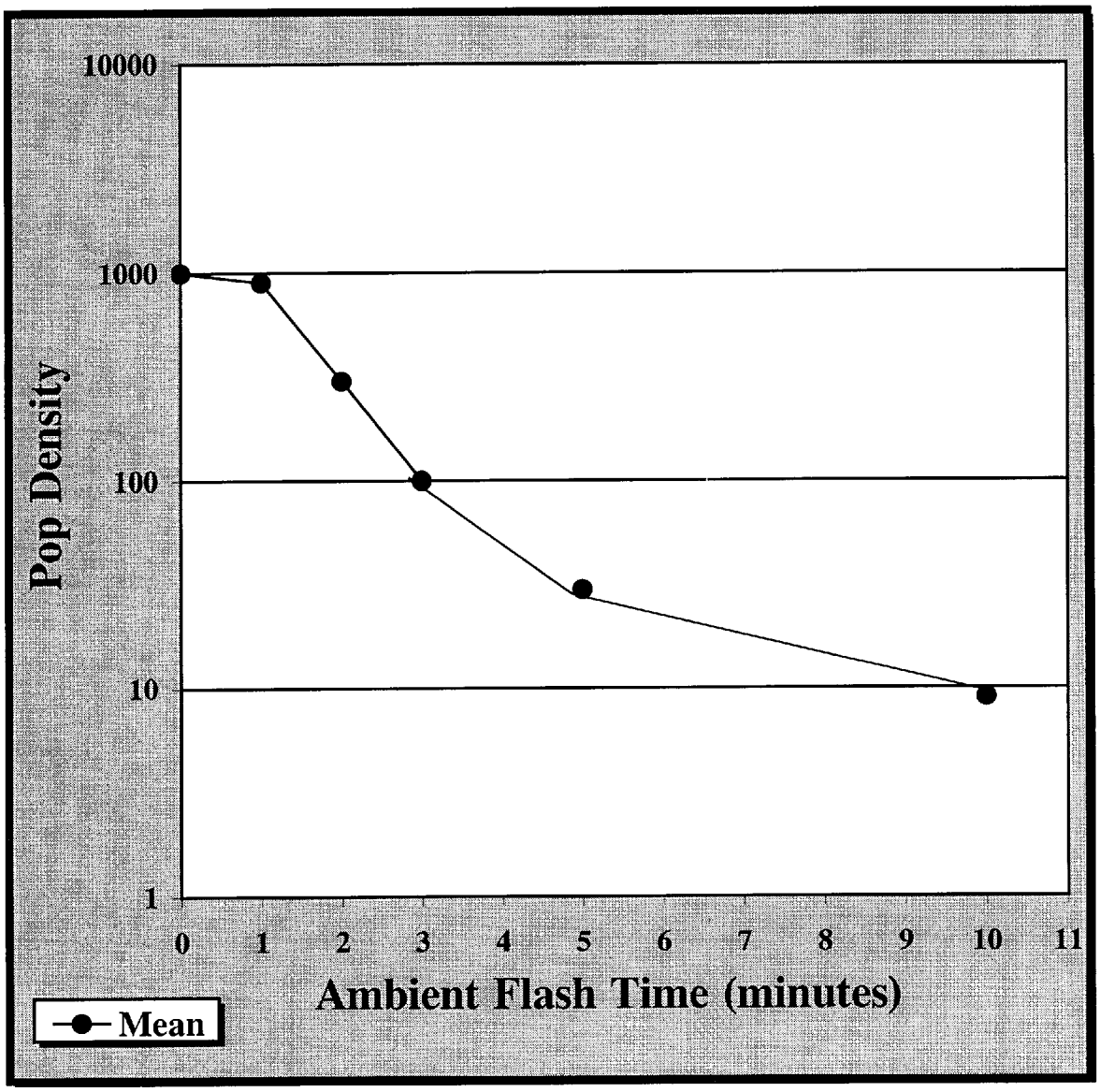
FIG. 3 is a plot showing the effect of the length of the ambient flash on the frequency of pop defects.

Referring initially to FIG. 1, a paint system for vehicle bodies is shown. Paint system 10 is shown to include a base-coat paint booth 12, a flashing area 13, a clear-coat paint booth 16, and a cure oven 18. A water-borne high-solids automotive base coat paint, such as PPG HWB S90394, is applied to the vehicle bodies as they are processed through the base-coat paint booth 12. The booth typically contains automatic (i.e., robotic) stations as well as manual stations for accessing tight areas and touch-up.

Vehicle bodies exiting the base-coat paint booth 12 proceed to a flashing area 13 where the paint is dehydrated to vaporize both solvents (VOC's) and water from the paint, causing the paint to set. Heating means, usually convection ovens or infrared heating elements, were included in the prior art flashing areas to elevate the temperature of the vehicle bodies. The heating means were typically configured without regard to the peak metal temperature of the object being painted, and peak metal temperatures in excess of 160° F. were not uncommon.

Vehicle bodies are next processed through a clear-coat paint booth 16 which is configured in a similar manner to that of the base-coat paint booth. Clear paint is applied to the vehicle body over the semi-dry base-coat. Vehicle bodies are then processed through a curing oven which operates at an elevated temperature to simultaneously cure both the base-coat and the clear-coat.

In comparison to the prior art flashing methods, the method of the present invention utilizes a two-part flashing process to control and substantially reduce pop defects. Additionally, the method of the present invention is also useful for reducing orange peel. Vehicle bodies entering into a flashing area operated in accordance with the teachings of the present invention are first flashed at a first set of environmental conditions for a predetermined time after which the peak metal temperature of the vehicle body is raised to a predetermined range and this level of heat is maintained until the paint on the vehicle body has dehydrated to a predetermined level. In the preferred embodiment, flashing area 13 is comprised of a quiescent flashing area 14 and a heated flashing area 15 as is shown in FIG. 1A. For reasons which are detailed below, it is also preferred that the quiescent flashing area 14 be contiguous with the base-coat paint booth 12.

Referring now to FIG. 2, the method of the present invention is shown in flow chart form. As indicated in block 20, the temperature, relative humidity and air velocity (hereinafter referred to collectively as the environmental conditions) in the quiescent flashing area 14 during the first portion of the flashing process are controlled within the following ranges:

temperature within a range of approximately 60 to 100° F., and preferably from 68 to 78° F.;

relative humidity within a range of approximately 50 to 100%, and preferably from 53 to 73%; and air velocity within a range of zero (0) to 100 feet per minute.

It should be appreciated that the use of word "quiescent" in describing the first portion of the flashing process should not to be interpreted to mean that the vehicle body remain motionless. Rather, the use of the word "quiescent" merely reflects the need to maintain the vehicle body at the first environmental conditions in a state of repose. Due to the similarities between the environmental conditions of the quiescent flashing area 14 and those commonly associated with the operation of a base-coat paint booth, it is advantageous, although not required, that these areas be contiguous. This approach allows the environment of both areas to be controlled with a minimal capital investment. Once the environmental conditions of the quiescent flashing area 14 have been brought within their individual ranges, painted vehicle bodies are then introduced to the quiescent flashing area 14 as indicated in block 22.

Block 24 represents the final step in the first portion of the flashing process wherein the vehicle bodies are subjected to the environmental conditions of the quiescent flashing area 14 for a first time of approximately 2 to 10 minutes and preferably from 4 to 6 minutes. As shown in FIG. 3, the frequency of pop defects is substantially reduced by flashing at ambient air temperatures for periods extending approximately two to ten minutes in length.

Block 26 represents the first step of the second portion of the flashing process wherein the vehicle body is introduced to the heated flashing area 15 and heated through heating means to dehydrate the paint film. Any conventional heating means (e.g., convection ovens, infrared heaters) can be used to heat the vehicle body as factors other than peak metal temperature, including the rate of heat ramp and infra-red wavelength, have a negligible effect on the frequency of pop defects. It is preferred, however, that the heating means allow the vehicle body to achieve a uniform temperature profile across the vehicle body.

Figure 4:
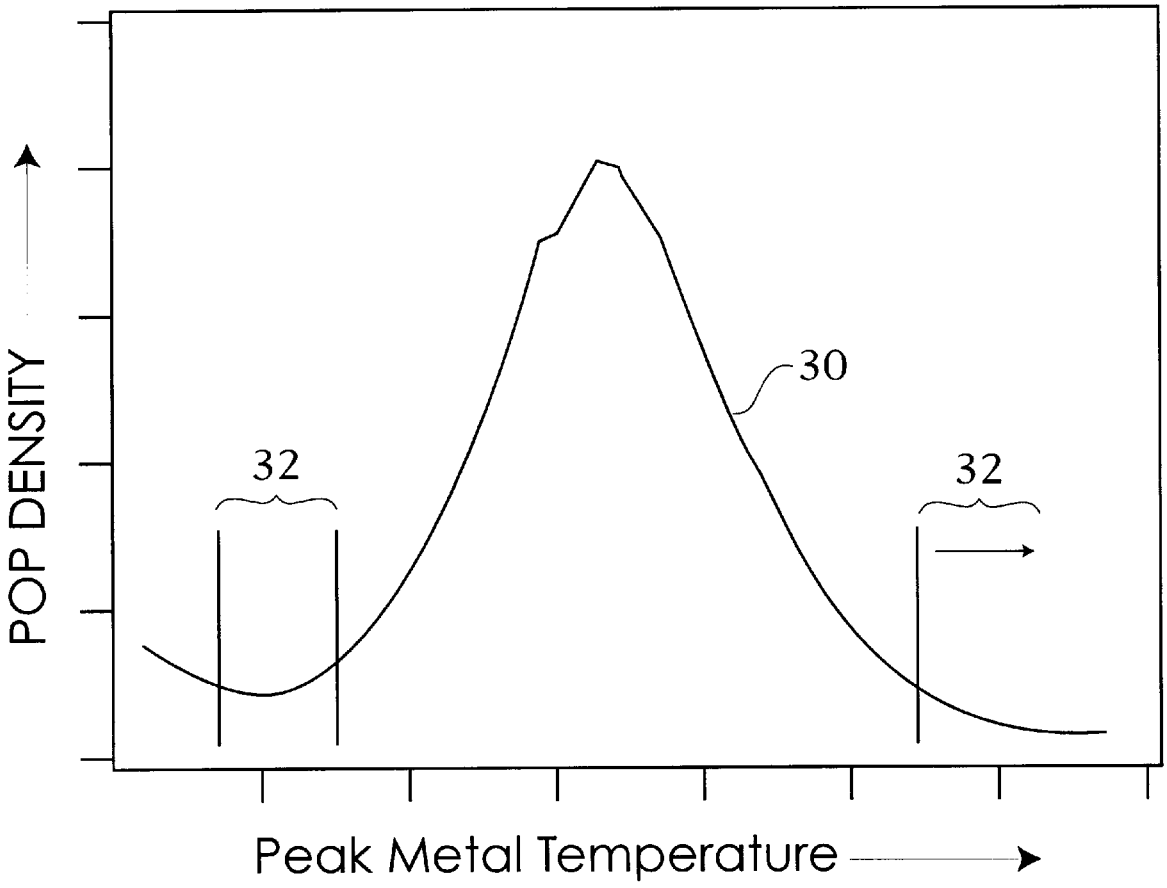
FIG. 4 is a plot showing the effect of the dehydration temperature on the frequency of pop defects.

Briefly, FIG. 4 is a plot showing the relationship between the peak metal temperature of the vehicle body and the frequency of pop defects. The curve 30 is generally bell-shaped with two areas on either side of the bell producing pop defects at a significantly reduced rate. The first area 32 represents a low dehydration temperature range of approximately 100 to 140° F., with optimal results occurring from 100 to 110° F. The second area 34 represents a high dehydration temperature range of approximately 240 to 300° F.

Returning to FIG. 2, the heating means in the preferred embodiment are operable for elevating the peak metal temperature of the vehicle body to a point within the low dehydration temperature range (i.e. approximately 100 to 140° F., and preferably approximately 100 to 110° F.). It is also preferred that the relative humidity of the area be less than 50% and that the air velocity be greater than 400 feet per minute to facilitate dehydration of the paint film.

In an alternate embodiment of the present invention, the heating means are operable for elevating the peak metal temperature of the vehicle to a point within the high dehydration temperature range (i.e., approximately 240 to 300° F.). However, increased energy costs are associated with the operation of the heating means at this temperature and an issue exists regarding the compatibility of several formulations of clear-coat paint with base-coats subjected to such elevated temperatures.

Block 28 represents the last step of the second portion of the flashing process wherein the peak metal temperature of the vehicle body is maintained at the second temperature for such a time until the paint has dehydrated to a level within the paint manufacturer's specifications.

While it will be apparent that the preferred embodiments of the invention disclosed are well calculated to provide the above stated advantages, it will be appreciated that the invention is susceptible to modification, variation and change without departing from the proper scope or fair meaning of the subjoined claims. For example, it would be effective to perform the first portion of the flashing process in the base-coat paint booth. Alternatively, it would also be effective to combine the quiescent and heated flashing areas and operate the combined area alternating between the quiescent and heated stages so as to perform the flashing process in a batch-type manner.

What is claimed is:

1. A method for flashing an object painted with a water-borne high-solids automotive paint comprising the steps of:

introducing said object into a flash area operated at a first environmental condition, said first environmental condition including a first temperature of approximately 60 to approximately 100° F.;

subjecting said object to said first environmental condition for a predetermined time;

heating said object to a second temperature; and dehydrating a painted surface of said object to a predetermined level.

2. The method of claim 1 wherein said water-borne high-solids automotive paint is PPG HWB S90394.

3. The method of claim 1 wherein said first environmental condition includes a first relative humidity of approximately 50 to 100 percent.

4. The method of claim 1 wherein said first environmental condition includes a first air velocity of approximately zero (0) to 100 feet per minute.

5. The method of claim 1 wherein said predetermined time is approximately 2 to 10 minutes.

6. The method of claim 1 wherein said second temperature is a peak temperature of approximately 100 to 140° F.

7. The method of claim 6 wherein said object is heated through convection heating means.

8. A method for flashing an object painted with a water-borne high-solids automotive paint comprising the steps of:

introducing said object into an area operated at a temperature of approximately 68 to 78° F., a relative humidity of approximately 53 to 73% and having an air velocity of approximately zero (0) to 100 feet per minute;

subjecting said object to said first temperature for a time of approximately 4 to 6 minutes;

heating said object to a peak temperature of approximately 100 to 110° F. in an environment having a relative humidity of less than 50% and an air velocity of greater than 400 feet per minute; and dehydrating a painted surface of said object to a predetermined level.

9. The method of claim 8 wherein said water-borne high-solids automotive paint is PPG HWB S90394.

* * * * *